United States Patent [19]

Aronica

[11] 4,370,782

[45] Feb. 1, 1983

[54] BELT RETAINER

[75] Inventor: John A. Aronica, Southboro, Mass.

[73] Assignee: The Kendall Company, Walpole, Mass.

[21] Appl. No.: 180,681

[22] Filed: Aug. 25, 1980

[51] Int. Cl.[3] ..... A41B 9/00

[52] U.S. Cl. ..... 24/198; 24/23 B; 24/200; 2/114; 2/DIG. 7

[58] Field of Search ..... 2/114, DIG. 7; 24/200, 24/23 B, 198, 176, 186, 74 A, 67.9, 259 PF, 255 P

[56] References Cited

U.S. PATENT DOCUMENTS

| | | | |
|---|---|---|---|
| 1,314,338 | 8/1919 | Kors | 24/23 B |
| 2,058,931 | 10/1936 | Williams | 24/200 |
| 2,224,773 | 12/1940 | Shaulson | 24/23 B X |
| 2,648,880 | 8/1953 | Brown | 24/23 B |
| 3,555,626 | 1/1971 | Terada | 24/198 |
| 3,864,757 | 2/1975 | Hartigan | 2/114 |
| 4,019,207 | 4/1977 | Newman et al. | 2/DIG. 7 |

*Primary Examiner*—Roy D. Frazier
*Assistant Examiner*—Peter A. Aschenbrenner

[57] ABSTRACT

A belt retainer for securing the belt of a disposable sterile operating room gown comprises a generally rectangular strip of semi-rigid deformable material having a continuous belt retaining and locking cutout slot therein. The cutout slot defines a central upwardly extending tab, a narrow downwardly extending tab extension connected to the central tab adjacent one side edge of the central tab, and a side downwardly extending tab positioned adjacent the opposite side edge of the central tab.

3 Claims, 12 Drawing Figures

BELT RETAINER

The present invention relates to a disposable belt retainer for the belt of a sterile operating room gown.

There are a variety of belt retainers in the prior art for use in securing the belts of disposable "sterile back" operating room gowns. However, such belt retainers have proved to be deficient in a number of respects. For example, they may require the gown wearer to use both hands to secure the belt, or may not permit adjustment of the belt around the wearer, or they may require apertures in the belt which limits its adjustability.

It is, therefore, an object of the present invention to provide a novel belt retainer suitable for retaining a non-apertured belt of a sterile operating room gown.

The invention features a novel disposable belt retainer which comprises a generally rectangular strip of semi-rigid deformable material having a back surface adapted to be attached to a disposable sterile operating room gown, a front surface, opposite side edges, top and bottom edges connecting the opposite side edges, and a continous belt retaining and locking cutout slot spaced inwardly from the edges. The cutout slot has an upper horizontal belt inserting portion adjacent the top edge, a vertical belt receiving portion extending downwardly from each of the opposite ends of the horizontal belt inserting portion adjacent each of the side edges, and a vertical belt clamping and locking slit portion connected to and extending upwardly from the lower end of at least one and, preferably, each of the vertical belt receiving portions.

The cutout slot defines a central upwardly extending tab connected to the strip adjacent the strip bottom edge with an upper edge portion adjacent to and spaced downwardly from the strip top edge, a downwardly extending tab extension connected to the central tab upper edge portion adjacent one side edge of the central tab and positioned adjacent one of the strip side edges, and a side downwardly extending tab connected to the strip adjacent the strip top edge and positioned between one side edge of the central tab, preferably opposite the tab extension, and the opposite one of the strip side edges.

To secure the belt in the belt retainer, the belt may be inserted into the retainer by grasping the belt's free end, extending it horizontally, moving a horizontally extended belt portion bodily downwardly through the upper horizontal belt inserting slot portion behind the central tab into the downwardly extending vertical belt receiving slot portions, and finally moving the horizontally extended belt portion upwardly into the upwardly extending belt clamping and locking slit portions.

The horizontally extended belt portion in its secured position is positioned in front of the front surface of the strip adjacent the strip side edges and in front of the tab extension and behind the central and side tabs. The deformability of the tabs permits release of the belt by grasping its free end and pulling the secured belt portion forwardly out of the retainer by bending the tabs and tab extension.

In an alternative embodiment of the invention, the strip back surface has adhesive thereon and is adapted to be releasably attached to the gown at a first location, and then removed and attached to the gown at another location.

Other objects, features, and advantages of the present invention will appear from the following detailed description of preferred embodiments thereof, taken together with the accompanying drawings, wherein.

Figure 1:
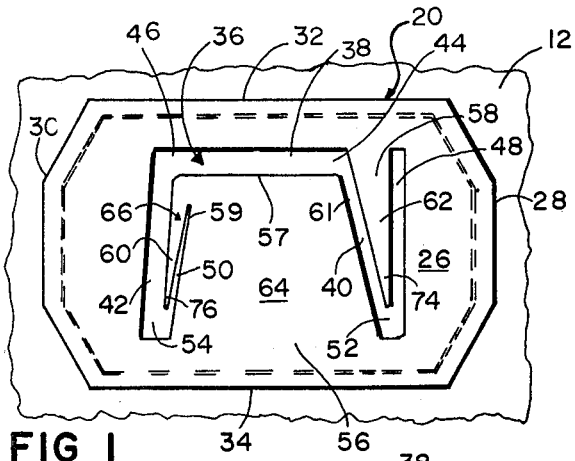
FIG. 1 is an enlarged front view of a first embodiment of the belt retainer of the invention.
Figure 2:
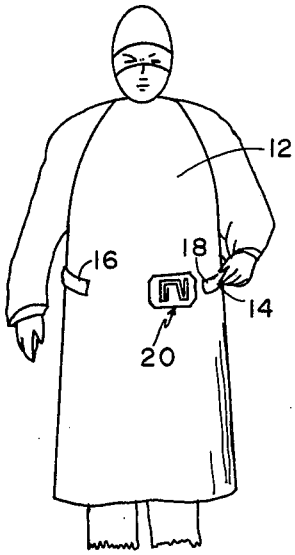
FIG. 2 is a perspective view of the belt retainer of FIG. 1, as attached to a sterile operating room gown.
Figure 3:
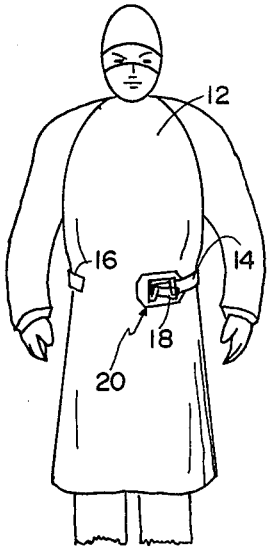
FIG. 3 is a perspective view of the belt retainer of FIG. 2, with the free end of the belt secured in the belt retainer.

Referring to the drawings, and particularly to FIGS. 2 and 3, the disposable belt retainer of the invention, generally designated 20, is shown attached at the waist of a sterile disposable operating room gown, generally designated 12. Belt retainer 20 is made of inexpensive semi-rigid deformable sheet material such as plastic, cardboard or the like. Also shown is a non-apertured belt 14 having one end 16 attached to the waist of gown 12 at a point opposite belt retainer 20. Free end 18 of belt 14 surrounds the waist of gown 12.

More specifically, as best shown in FIGS. 4 through 8, the novel belt retainer 20 of the invention comprises a generally rectangular strip of semi-rigid deformable material which has a back surface adapted to be attached to operating room gown 12, a front surface 26, opposite side edges 28 and 30, top and bottom end edges 32, 34 connecting side edges 28 and 30, and a continuous belt retaining, clamping and locking cutout slot 36 spaced inwardly from edges 28, 30, 32 and 34. Cutout slot 36 has an upper horizontal belt inserting portion 38 adjacent top edge 32, vertical belt receiving portions 40 and 42 extending downwardly from opposite ends 44 and 46 of horizontal portion 38 adjacent each of side edges 28 and 30, respectively, and vertical belt clamping and locking slit portions 48 and 50 connected to and extending upwardly from lower ends 52 and 54 of belt receiving portions 40 and 42, respectively.

Cutout slot 36 defines a wide central upwardly extending tab 56 connected to the strip adjacent strip bottom edge 34 with an upper edge portion 57 adjacent to and spaced downwardly from strip top edge 32, a narrow downwardly extending tab extension 60 connected to central tab upper edge portion 57 adjacent side edge 59 of central tab 56 and positioned adjacent strip side edge 30, and a narrow downwardly extending side tab 58 connected to the strip adjacent strip top edge 32 and positioned between side edge 61 of central tab 56 and strip side edge 28. Side tab 58, central tab 56 and tab extension 60 each has a front surface 62, 64, 66 and a back surface defined by corresponding front and back surfaces 26 and 24, respectively, of the strip.

Belt 14 is secured in belt retainer 20 by being positioned above front surface 26 of strip side edge 28, beneath back surfaces of side and central tabs 58, 56, and above front surface 66 of tab extension 60.

Figure 11:
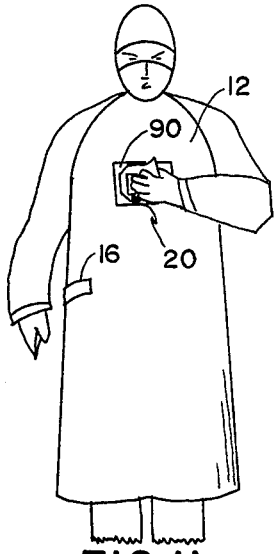
FIG. 11 is a perspective view of a still further embodiment of the belt retainer of FIG. 1, as releasably attached to a first portion on a sterile operating room gown.
Figure 12:
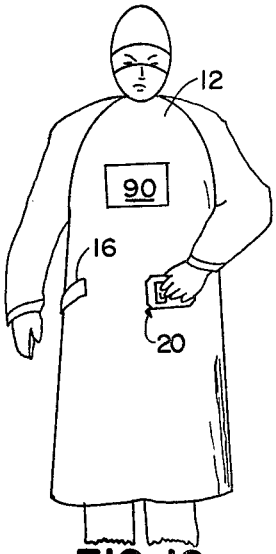
FIG. 12 is a perspective view of the belt retainer of FIG. 11, with the belt retainer attached to another location on the gown.

In an alternative embodiment of the invention, as shown in FIGS. 11 and 12, a belt retainer 20 is releasably attached to gown 12 at a first location on gown 12 such as the upper front surface of gown 12. The strip back surface of belt retainer 20 has a layer of adhesive thereon which is adapted to be releasably attached to a piece of release paper 90 attached to gown 12. After detaching belt retainer 20 from release paper 90, belt retainer 20 may be attached to an appropriate location on gown 12 such as the waist of gown 12.

The operation of inserting and securing belt 14 within belt retainer 20 may be accomplished using only the left hand. As best shown in FIGS. 2 and 3, free end 18 of belt 14 is grasped and horizontally extended by wearer, brought around the waist of operating room gown 12, and the horizontally extended portion of belt 14 is positioned above belt retainer 20.

Figure 4:
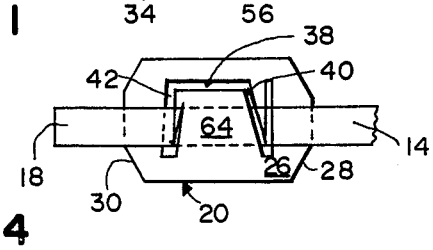
FIGS. 4 through 8 illustrate a sequence of steps for securing the free end of the belt in the belt retainer.

As best shown in the sequence of FIGURES beginning with FIG. 4, the horizontally extended portion of belt 14 is first positioned parallel to and above belt retainer 20 and is then moved downwardly through upper horizontal belt inserting slot portion 38 into belt receiving slot portions 40, 42 and placed behind and in contact with back surfaces of central tab 56 and tab extension 60. The remaining portions of belt 14 are in contact with front surface 26 of side edges 28 and 30, and front surface 62 of side tab 58.

Figure 5:
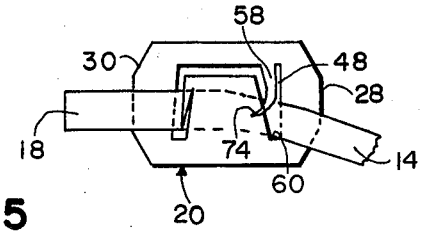

As shown in FIG. 5, side tab 58 is then pulled upwardly and outwardly from its original position, and portion 80 of belt 14 adjacent to side tab 58 is crimped down to reduce its height in order to clear the lower tip 74 of side tab 58. The crimped portion 80 of belt 14 is then pulled upwardly into slit portion 48 to secure belt 14 in belt locking slit portion 48 in contact with back surface of side tab 58.

Figure 6:
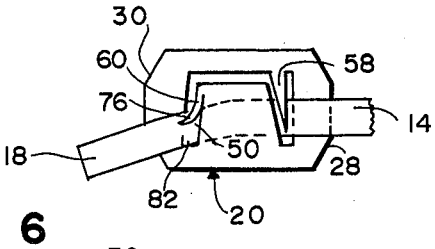

Next, as shown in FIG. 6, tab extension 60 is pulled upwardly and outwardly from its original position, and portion 82 of belt 14 adjacent to tab extension 60 is crimped down to clear lower tip 76 of tab extension 60. The crimped portion 82 of belt 14 is then pulled upwardly into belt locking slit portion 50 to secure it in contact with front surface 66 of tab extension 60.

Figure 7:
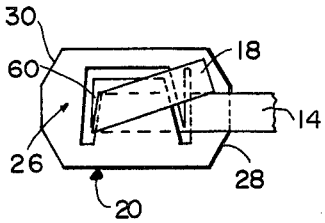
Figure 8:
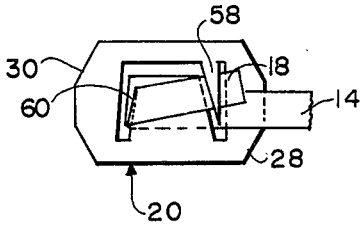

Finally, to prevent slippage of belt 14 and to present a neat appearance, free end 18 of belt 14 is folded back and secured under side tab 58, as shown in FIGS. 7 and 8.

To adjust belt 14, free end 18 of belt 14 is removed from under side tab 58 and returned to the position shown in FIG. 7, with belt 14 in contact with front surface 26 of strip side edges 28 and 30, back surfaces of side and central tabs 58, 56, and front surface 66 of tab extension 60; allowing horizontal adjustment of belt 14.

To release belt 14, the wearer grasps free end 18 of belt 14 and pulls it outwardly from belt retainer 20, bending the deformable side and central tabs 58, 56 and tab extension 60.

In an alternative embodiment of the invention, as shown in FIGS. 11 and 12, the wearer must first detach belt retainer 20 from release paper 90, and then attach belt retainer 20 to an appropriate location on gown 12 before he inserts and secures belt 14 within belt retainer 32, as described previously.

Figure 9:
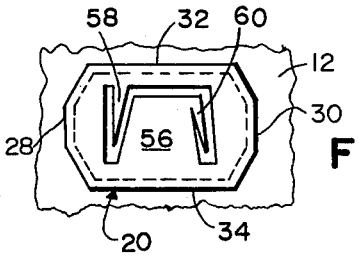
FIG. 9 is a front view of another embodiment of the belt retainer of the invention.

A further alternative embodiment of belt retainer 20, as shown in FIG. 9, shows a "right-hand" model which allows the wearer to use only his right hand in securing belt 14 in belt retainer 20.

Figure 10:
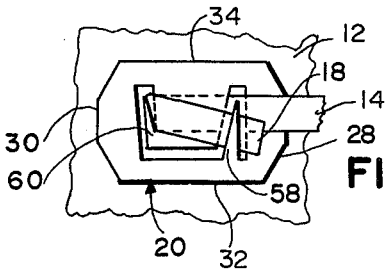
FIG. 10 is a front view of a further embodiment of the belt retainer of the invention.

It will be apparent to those skilled in the art that various modifications may be made within the spirit of the invention and the scope of the appended claims. For example, as shown in FIG. 10, the belt retainer 20 of the invention may be inverted, providing a downwardly extending central tab 56 and upwardly extending side tab 58 and tab extension 60.

What is claimed is:

1. A disposable belt retainer for securing a non-apertured belt of a sterile operating room gown, said belt having one end attached to said gown adjacent the waist of said gown and a free end extending around said waist, said disposable belt retainer comprising, a generally rectangular strip of semi-rigid deformable material having a back surface adapted to be attached to said gown, a front surface, opposite generally vertical edges, top and bottom edges connecting said opposite vertical edges, and a continuous belt retaining and locking cutout slot spaced inwardly from said edges, said cutout slot having an upper horizontal belt inserting portion adjacent said top edge, a vertical belt receiving portion extending downwardly from each of the opposite ends of said horizontal belt inserting portion adjacent each of said vertical edges, and two vertical belt clamping and locking slit portions, one thereof being connected to and extending upwardly from the lower end of each of said vertical belt receiving portions said cutout slot defining a central vertically extending tab connected to said strip adjacent said strip bottom edge with an upper edge portion adjacent to and spaced downwardly from said strip top edge, said central tab having a downwardly extending tab extension connected to said central tab upper edge portion adjacent one side edge of said central tab and positioned adjacent one of said strip side edges, and a side downwardly extending tab connected to said strip adjacent said strip top edge and positioned between the vertical edge of said central tab opposite said tab extension and the opposite one of said strip side edges whereby, said belt may be inserted into said retainer to secure it therein by grasping its free end to extend it horizontally, then moving a horizontally extending belt portion bodily downwardly through said upper horizontal belt inserting slot portion behind said central tab into said downwardly extending vertical belt receiving slot portions and finally moving said horizontally extended belt portion upwardly into said upwardly extending belt clamping and locking slit portions the deformability of said tabs permitting release of said belt by grasping its free end and pulling said secured belt portion forwardly out of said retainer by bending said tabs and tab extension.

2. A disposable belt retainer for securing a non-apertured belt of a sterile operating room gown, said belt having one end attached to said gown adjacent the waist of said gown and a free end extending around said waist, said disposable belt retaining comprising a generally rectangular strip of semi-rigid deformable material having a back surface, a front surface, opposite generally vertical edges, top and bottom edges connecting said opposite vertical edges, and a continuous belt retaining and locking cutout slot spaced inwardly from said edges said back surface having adhesive thereon adapted to be releasably attached to said gown at a first location and then attached to said gown at another location said cutout slot having an upper horizontal belt inserting portion adjacent said top edge, a vertical belt receiving portion extending downwardly from each of the opposite ends of said horizontal belt inserting portion adjacent each of said vertical edges, and a vertical belt clamping and locking slit portion connected to and extending upwardly from the lower end of each of said vertical belt receiving portions said cutout slot defining a central upwardly extending tab connected to said strip adjacent said strip bottom edge with an upper portion adjacent to and spaced downwardly from said strip top edge and two generally vertical boundary portions, said central tab having a downwardly extending tab extension connected to said central tab upper portion adjacent one vertical boundary portion of said central tab and positioned adjacent one of said strip vertical edges, and a side downwardly extending tab connected to said strip adjacent said strip top edge and positioned between the vertical boundary portion of said central tab opposite said tab extension and the opposite one of said strip vertical edges.

whereby, said belt may be inserted into said retainer to secure it therein by grasping its free end to extend it horizontally, then moving a horizontally extended belt portion bodily downwardly through said upper horizontal belt inserting slot portion behind said central tab into said downwardly extending vertical belt receiving slot portions and finally moving said horizontally extended belt portion upwardly into said upwardly extending belt clamping and locking slit portions said horizontally extended belt portion in secured position being positioned in front of said strip adjacent one of said strip edges, behind said side downwardly extending tab, behind said central tab, passing outward between said tab extension and said central tab, in front of said central tab, and behind said side tab, the deformability of said tabs permitting release of said belt by grasping its free end and pulling said secured belt portion forwardly out of said retainer by bending said tabs and tab extension.

3. A belt retaining structure including an area of web having therein a continuous cutout slot, said slot having in sequential order starting from an initial end of said slot a first slot portion, proceeding generally transversely to the long dimension of the belt to be secured, a second slot portion proceeding generally transversely to the long dimension of the belt to be secured and in the direction opposite to the direction of said first portion, a third slot portion proceeding generally in the direction of the long dimension of the belt to be secured and in a direction away from said initial slot end, a fourth slot portion of about the same length as said second slot portion proceeding generally transversely in the direction in which said first portion proceeded, a fifth slot portion, shorter than said fourth slot portion proceeding generally transversely in the direction opposite that of said first portion and lying to the side of said fourth portion closer to said second portion, said slot defining between its first and second portions a first tab, between its second, third and fourth portions a second tab, and between its fourth and fifth portions a third tab, said third tab being within said second tab, permitting a belt to be secured by passing in order beneath said first tab, beneath said second tab, between said second and third tab while reversing direction, on top of said second tab, and beneath said first tab, and bending of said tabs permitting release of a secured belt by pulling outwards its free end.

* * * * *